US006416418B1

(12) United States Patent
Kleimeyer

(10) Patent No.: US 6,416,418 B1
(45) Date of Patent: Jul. 9, 2002

(54) PIVOTING-ARM GIANT SWING AMUSEMENT RIDE

(76) Inventor: Mark Kleimeyer, P.O. Box 27540, 120 Dragon Cir., Panama City Beach, FL (US) 32411

( * ) Notice: Subject to any disclaimer, the term of this patent is extended or adjusted under 35 U.S.C. 154(b) by 0 days.

(21) Appl. No.: 09/911,307

(22) Filed: Jul. 23, 2001

(51) Int. Cl.[7] ..... A63G 9/00
(52) U.S. Cl. ..... 472/118; 472/119
(58) Field of Search ..... 472/118, 119, 472/125, 49, 50, 131, 135

(56) References Cited

U.S. PATENT DOCUMENTS 5,267,906 A 12/1993 Kitchen et al.
5,658,201 A 8/1997 Kleimeyer et al.
5,709,606 A * 1/1998 Ehrman ..... 472/29
5,803,815 A 9/1998 Kitchen et al.
5,842,928 A 12/1998 McGinnis
5,957,779 A * 9/1999 Larson ..... 472/34
5,989,127 A 11/1999 Kitchen et al.

* cited by examiner

*Primary Examiner*—Kien T. Nguyen
(74) *Attorney, Agent, or Firm*—Michael J. Mehrman; Gardner Groff & Mehrman, PC

(57) ABSTRACT

An elevated support beam has a boom arm and two cam arms that pivot between a lower loading position and an elevated operating position. A passenger carriage is suspended from the cam arms and is releasably attached to the boom arm. When the passenger carriage is released from the boom arm with the cam arms locked in the operating position, it swings back and forth but is elevated safely from the ground because of the elevated cam arms. Alternative embodiments include separately pivotal boom and cam arms, a support arm sufficiently thick that the cam arms are not required, and movable solid or fluid counterweights. A method of swinging a passenger includes pivoting the boom arm and the cam arms to the operating position, locking the cam arms in the operating position, and permitting the carriage to swing from the cam arms safely above the ground.

45 Claims, 11 Drawing Sheets

PIVOTING-ARM GIANT SWING AMUSEMENT RIDE

TECHNICAL FIELD

The present invention relates to amusement rides and, more particularly, to a giant swing ride with a pivotal boom arm and pivotal cam arms for elevating a passenger and then releasing the passenger into a swinging motion.

BACKGROUND OF THE INVENTION

Amusement rides of a variety of types have provided great thrills to many people over the years. One type of ride is a giant swing ride that swings a rider back and forth through the air in an arc. Known swing rides have a harness suspended from a cable that is attached to one (and sometimes more than one) elevated support structure. One (and sometimes more than one) separate and spaced apart elevated launch structure is used to lift the rider to an elevated position, so that the rider can then be released from the launch structure to swing from the support structure under the force of gravity. In order to prevent the rider from swinging too close to the ground, typical swing rides include a winch for taking in a length of the cable, a lift for raising a portion of the support structure, or a platform for loading the passenger into the carriage. One such known swing ride is disclosed by U.S. Pat. No. 5,267,906, which is hereby incorporated herein by reference.

While these giant swing rides generally provide a thrill to the rider, they have their drawbacks. Because they include one or several large support structures for swinging the rider, and a large, separate, and spaced apart launch structure for lifting the rider to the launch position, they require a relatively large amount of ground space and are costly to manufacture and maintain. Also, because they require a mechanism for preventing the rider from swinging too close to the ground, such as a winch, lift, or platform, they include additional lifting components that are costly to manufacture and maintain.

Also, conventional amusement rides include giant oscillating rides that launch a rider up and over the top of support structures in a generally circular or semicircular motion. These rides typically have a single support structure, or two support structures that are closely spaced, which support a pivotal or rotary arm with a rider or capsule attached thereto. These rides are fundamentally different from the swing rides described above, because they operate to pull or propel the rider up and through the air by the pivot arm, instead of permitting the rider to swing from cables under the force of gravity. Furthermore, while these rides require less lateral ground space than conventional swing rides, they nevertheless include costly support structures and also typically require complicated and costly counterweight and/or lifting mechanisms. Such known oscillating rides are disclosed by U.S. Pat. Nos. 5,989,127, 5,803,815, and 5,658,201, which are hereby incorporated herein by reference.

Accordingly, what is needed but not found in the prior art is giant swing ride that swings a rider back and forth through the air and that requires less ground space than known swing rides, without the need for two or more spaced apart, costly, and land-intensive support structures. Additionally, there is a need for giant swing ride that elevates the rider safely off the ground during the swinging motion, without the need for a costly winch, lift, platform, or like mechanism. Furthermore, there remains a need for such a swing ride that is reliable, safe, and has few moving components so that it is cost-effective to make and use.

SUMMARY OF THE INVENTION

Generally described, the present invention provides a giant swing amusement ride comprising a support tower and a support beam rotationally mounted to the support tower. The support beam has a boom arm and two (or another number of) cam arms extending therefrom, with the boom arm and the cam arms pivotal between a lowered loading position and an elevated operating position. A passenger carriage such as a flexible harness, rigid cage, or other suitable device for supporting one or more persons, is releasably coupled to the boom arm and is lifted by the boom arm between a lowered loading position and an elevated launch position. The passenger carriage is suspended from the cam arms by two (or another number of) cables that permit the passenger carriage to swing in a back and forth motion.

In this arrangement, one or more passengers can be loaded into the carriage in the loading position. When the support beam is rotated it pivots the boom arm and the cam arms from the loading position to the elevated operating position. By pivoting the boom arm to the operating position, the passenger carriage is lifted from the loading position to the launch position. Because the cam arms are now pivoted to the elevated operating position, the pivot point for the swinging motion is correspondingly raised. Therefore, when the passenger carriage is released from the boom arm in the operating position, the passenger carriage swings from the cam arms back toward the loading position but is elevated with respect to the loading position by the elevated cam arms in the operating position.

Accordingly, the pivoted cam arms provide ground clearance so that the passenger carriage can swing back and forth in a pendulum path elevated safely from the ground, without the need for a winch, lift, movable loading platform, or the like. Also, because the cam arms and the boom arm are mounted on one (or two closely spaced) support tower(s), there is no need for a separate, costly, and land-intensive launch tower. In this way, the present invention provides a giant swing ride that is reliable, safe, and has few moving components so that it is cost-effective to make and use.

In a first exemplary embodiment of the invention, a first actuator operates to rotate the support beam between the loading position and the operating position. Also, the cam arms are selectively locked from pivoting when in the operating position by the actuator (or are otherwise prevented from pivoting). Additionally, the cam arms each have a length that is shorter than a length of the boom arm and that is sufficiently long so that the passenger carriage swings above and does not contact the ground. In this manner, the giant swing can be operated easily to raise the passenger carriage from the loading position to the launch position, and then the carriage can be easily launched to swing safely above the ground.

In a second exemplary embodiment of the invention, the boom arm and the cam arms are pivotally mounted to the support beam so that they pivot independently of each other. Also, a second actuator operates to pivot the boom arm, while the first actuator operates to pivot the cam arms. In this configuration, the first actuator can be operated to pivot the cam arms and lift the passenger carriage off the ground, so that any straps or other passenger securing devices of the carriage can be checked for safety. Then the second actuator can be operated to pivot the boom arm to lift the carriage to the launch position for release into the swinging motion.

In a third exemplary embodiment of the invention, the carriage is elevated safely from the ground during its swinging motion not by cam arms but by the thickness of the support beam itself. In this embodiment, the cables are attached directly to the support beam at attachment portions, and the support beam has a thickness such that, when the boom arm is pivoted to the operating position and the passenger carriage is released, the passenger carriage swings back toward the loading position but is elevated with respect to the loading position by the thickness of the support beam. Accordingly, the cam arms need not be provided, and the thickness of the support beam, when the attachment portions are rotated from the loading position to the operating position, safely elevates the passenger carriage from the ground while it swings back and forth through the air.

In a fourth exemplary embodiment of the invention, the boom arm is urged to pivot between the lowered loading position and the elevated operating position by a movable counterweight, with or without the assistance of the first or second actuator. The counterweight has a counterweight body movably mounted to a counterweight arm by a movable coupling such as a ball screw. A counterweight actuator operates to move the counterweight body closer to or farther from the support beam to provide the desired leverage for pivoting the boom arm.

In a fifth exemplary embodiment of the invention that produces a similar advantage as the fourth embodiment, a movable counterweight includes at least two storage tanks and a fluid that is transported therebetween by one or more actuators such as pumps. The counterweight actuator operates to move the counterweight fluid closer to or farther from the support beam to provide the desired leverage for pivoting the boom arm.

In another aspect of the invention, there is provided a method for swinging at least one passenger by an amusement ride. The method includes positioning a passenger carriage in a loading position, loading the passenger into or onto the passenger carriage, pivotally lifting a boom arm and cam arms to an elevated operating position to lift the passenger carriage to an elevated launch position, and releasing the passenger carriage from the boom arm. Then the passenger carriage swings back toward the loading position but is elevated with respect to the loading position by the elevated cam arms in the operating position. In this way, the carriage swings safely above the ground because of the elevated cam arms in the operating position. At the conclusion of the ride, after the passenger carriage swings until it comes to a stop, the cam arms are pivoted to the loading position and the passenger is unloaded from the carriage.

The specific techniques and structures employed by the invention to improve over the drawbacks of the prior devices and accomplish the advantages described above will become apparent from the following detailed description of the exemplary embodiments of the invention and the appended drawings and claims.

DETAILED DESCRIPTION OF THE EXEMPLARY EMBODIMENTS

Figure 1:
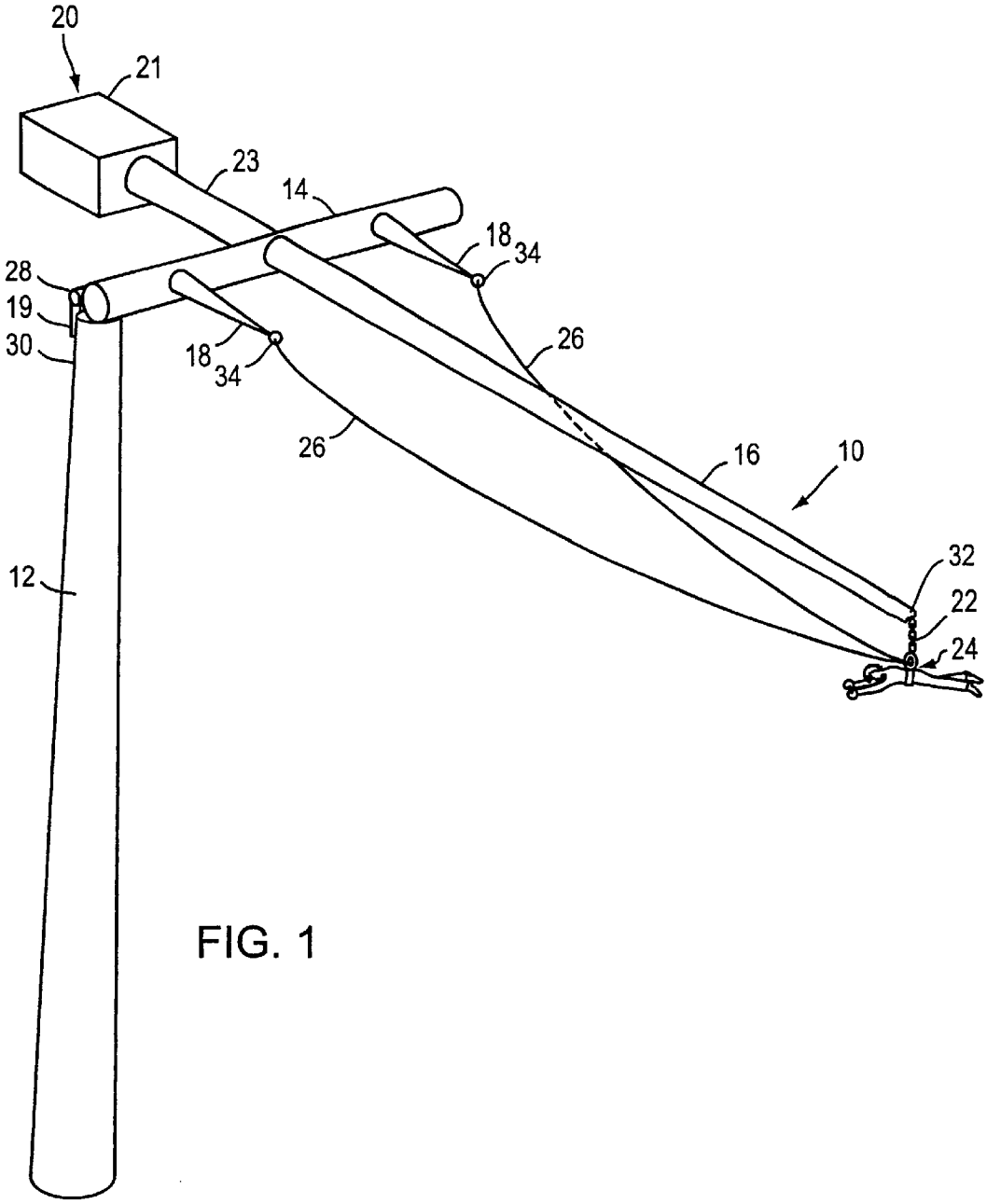
FIG. 1 is a perspective view of a first exemplary embodiment of the present invention, showing a swing ride with a support beam having a boom arm and two cam arms in an operating position and a passenger carriage in a launch position.

Referring to FIG. 1, there is illustrated a first exemplary embodiment of the present invention, referred to generally as the amusement ride or the swing ride 10. The swing ride 10 comprises a support tower 12 and a support beam 14 extending from the support tower. The support beam 14 has a boom arm 16 and two cam arms 18 extending therefrom that are pivotal between a lowered loading position and an elevated operating position (as depicted). The boom arm 16 and the cam arms 18 are selectively locked in the operating position by a brake 19. Also, the support beam 14 also has a counterweight 20 extending from the support beam 14 generally opposite from the boom arm 16, for assisting in pivoting the boom arm. A tether 22 is attached to the boom arm 16, and a passenger carriage 24 is releasably coupled to the tether. Two cables 26 are attached to the cam arms 18 and to the passenger carriage 24. An actuator 28 is operatively coupled to the support beam 14, wherein the actuator operates to rotate the support beam to cause the boom arm and the cam arm to pivot between the loading position and the operating position.

The support tower 12 has a portion 30 elevated from the ground, with the support beam 14 extending from the elevated portion 30 of the tower. Only one tower 12 need be provided, however, two closely spaced towers can support the support beam, or another number of towers can be provided, as may be desired. The tower 12 can be of a monopole, lattice, or other construction, made of steel or another material. For example, in order to provide a sleek, high tech appearance, the tower (and the support beam, boom arm, cam arms, and counterweight), can be made of steel pipe fabricated by Keeler Iron Works, Inc. of Memphis, Tenn. Alternatively, the tower 12 can be provided by a crane or the like, by the sides of walls such as in a canyon or in other recessed area, or by other elevated structures. Also, the tower 12 can be angled from vertical to provide increased clearance from the carriage 24 when it swings past the tower. Additionally, the height of the tower 12 can be selected for producing a desired swinging height and travel of the carriage 24. For example, in a typical commercial embodiment, the tower 12 has an installed height of about 107 feet.

The support beam 14 extends from the elevated portion 30 of the support tower 12, preferably in a generally horizontally position. Alternatively, the support beam 14 can be angled, curved, or have a varying thickness, to swing the passenger carriage 24 away from the tower 12 as the carriage swings back and further through the air. Of course, the support beam 14 (and the cam arms 28) can be configured differently to produce other swinging motions, as may be desired. Also, the support beam 14 is rotationally mounted to the support tower by a rotary bearing or another conventional mounting or coupling that permits the support beam to rotate about its axis. Additionally, the support beam 14 is selected to have a strength sufficient to bear the load of the boom arm 16, the cam arms 18, the cables 16, and the carriage 24 when swinging under the force of gravity, with an appropriate safety factor built-in. The boom arm 16 extends from the support beam 14, preferably in a generally perpendicularly configuration. The boom arm 16 has an attachment portion 32 at or near the opposite end of the boom arm 16 from the support beam 14. The length of the boom arm 16 is selected to be long enough so that the attachment portion 32 is positioned near the ground when the boom arm 16 is in the lowered loading position, so that one or more passengers can be loaded into or onto the carriage 24 in a carriage loading position. For example, in a typical commercial embodiment, the boom arm 16 has a length of about 100 feet. When the boom arm 16 is raised to the operating position, the passenger carriage 24 is lifted by the boom arm 16 from the carriage loading position to a carriage launch position.

The cam arms 18 extend from the support beam 14, preferably in a generally perpendicular configuration, with the boom arm 16 positioned between the cam arms. The cam arms 18 have attachment portions 34 at or near the opposite end of the cam arms 18 from the support beam 14. The length of the cam arms 18 is selected to be long enough so that, when the cam arms 18 and boom arm 16 are in the loading position, the attachment portions 34 are lowered to permit the passenger carriage 24 to be positioned near enough the ground that one or more passengers can be loaded into or onto the carriage 24. Of course, a platform can be provided for assisting in loading the passengers, but need not be provided. Furthermore, the length of the cam arms 18 is selected so that, when the cam arms 18 are raised to the operating position, the attachment portions 34 are raised so that the passenger carriage 24 swings safely above the ground from the attachment portions 34. Accordingly, the length of the cam arms 18 is less than the length of the boom arm 16. For example, in a typical commercial embodiment, the cam arms 18 have a length of about 7 feet.

In this configuration, when the support beam 14 is rotated between the loading position and the operating position, the boom arm 16 and cam arms 18 are pivoted from between the loading position and the operating position. Alternatively, the support beam 14 can be fixedly mounted to the tower 12, with the boom arm 16 and cam arms 18 pivotally mounted to the support beam 14 and pivoted by a hydraulic piston-cylinder or other device. Of course, the boom arm 16 and cam arms 18 can be mounted to the support beam 14 in other configurations that permit them to be raised and lowered between the loading operating positions.

It will be understood that the cam arms 18 preferably have the same length to swing the passenger carriage 24 in a pendulum-like motion. Alternatively, the cam arms 18 can be angled, curved, and/or each have a different length to swing the passenger carriage 24 away from the tower 12 as the carriage swings back and further through the air. Also, while two cam arms 18 are depicted in the drawing figures, it will be understood that only one cam arm can be provided generally vertically arranged relative to the boom arm 16, or more than two cam arms can be provided for supporting more than two cables 26.

The counterweight 20 extends from the support beam 14 preferably generally opposite from the boom arm 16, and has a weight selected to counterbalance the weight of the load supported by the boom arm 16. The counterweight 20 includes a body 21 mounted to an elongate arm 23 that is mounted to the support beam 14. The body 20 can be provided by a solid block of a heavy metal (or of most any other material), can have a rectangular shape (or most any other regular or irregular shape), and can have most any size (depending on the material and shape selected) to provide the desired counterweight to assist in raising and lowering the boom arm 16. By selecting the counterweight 20 to produce a downward gravitational force of about the same as the downward gravitational force of an average passenger and the boom arm 16 in the raised operating position (or close to it), the counterweight 20 and the boom arm 16 will about balance each other out. In this way, less force is required to raise and lower the boom arm 16, so that a lower powered actuator can be used. Alternative counterweights that are movable to better assist in raising and lowering the boom arm are described below.

The tether 22 is attached to the attachment portion 32 of the boom arm 16 and releasably attached to the passenger carriage 24. The tether 22 can be provided by cable, rope, chain, a web, or another support line, and can be made of steel, fabric, plastic, a composite, or another material. The tether 22 is attached to the attachment portion 32 of the boom arm 16 by, for example, a pin, eyelet, strap, bolts, or another fastener. Also, the tether 22 is releasably attached to the passenger carriage 24 by, for example, a releasable clasp, latch, pin, or other fastener permitting the tether to be released therefrom. The passenger carriage 24 can be released from the tether 22 manually by the operator of the swing ride 10 or automatically by a release mechanism (not shown) when the boom arm 16 reaches the operating position. The passenger carriage 24 can be provided in various forms to hold one or multiple passengers. For example, in a typical commercial embodiment, the passenger carriage 24 is provided by a harness for a single passenger, as is known in the art. Alternatively, the carriage 24 can be provided by a cage, car, capsule, other enclosure or frame, harness, flight suit, strap, belt, or other structure for holding one or more passengers or inanimate objects. Such as passenger carriages can be obtained form Undercover Chassis, Inc. of Leesburg, Fla., or from The Recovery Room company of Panama City Beach, Fla.

The passenger carriage 24 is lifted by the boom arm 16 from the lowered loading position to the raised launch position. When in the loading position, the passenger can be loaded into or onto the carriage 24, and when in the launch position, the carriage 24 is ready to be released from the boom arm 16 to swing from the cam arms 18.

Each of the cables 26 are attached to one of the attachment portions 34 of one of the cam arms 34 and to the passenger carriage 24 by, for example, a pin, eyelet, strap, bolt, clasp, latch, or another fastener. The cables 26 can be provided by rope, lifting cable, or another support line made of a material such as steel, as is commonly used in the crane industry. The size, shape, and material of the cables 26 are selected for safely handling the loads applied to the cable. Such cable, and the fasteners for attaching the cables to the carriage and to support beam, can be obtained from the West Florida Wire and Rope company of Panama City, Fla. Also, while two cables 26 are depicted in the drawing figures, it will be understood that only one cable or more than two cables can be provided, depending on the load and strength of cables selected.

The brake 19 is operatively coupled to the support beam 14 so that the cam arms 18 and the boom arm 16 can be selectively locked in the raised operating position during the operation of the swing ride 10 and released to pivot to the lowered loading position at the conclusion of the ride. Accordingly, the brake 19 can be provided by pawl and ratchet, a spring-loaded pin, a disc or drum brake assembly, a hydraulic, pneumatic, or electronic cylinder, a holding magnet, a combination of these brake devices, or another mechanical or electronic device configured to resist rotation of the support beam 14. Also, the brake 19 can be configured to automatically lock the boom arm 16 and the cam arms 18 upon their being raised to the operating position, or a control can be connected to the brake for the operator to manually operate the brake. For safety considerations and requirements, the brake 19 can be configured to lock the boom arm 16 and the cam arms 18 in the loading position during passenger loading, and/or a secondary brake of a similar or another type can be provided with a control for manual operation by the operator of the ride.

Figure 2:
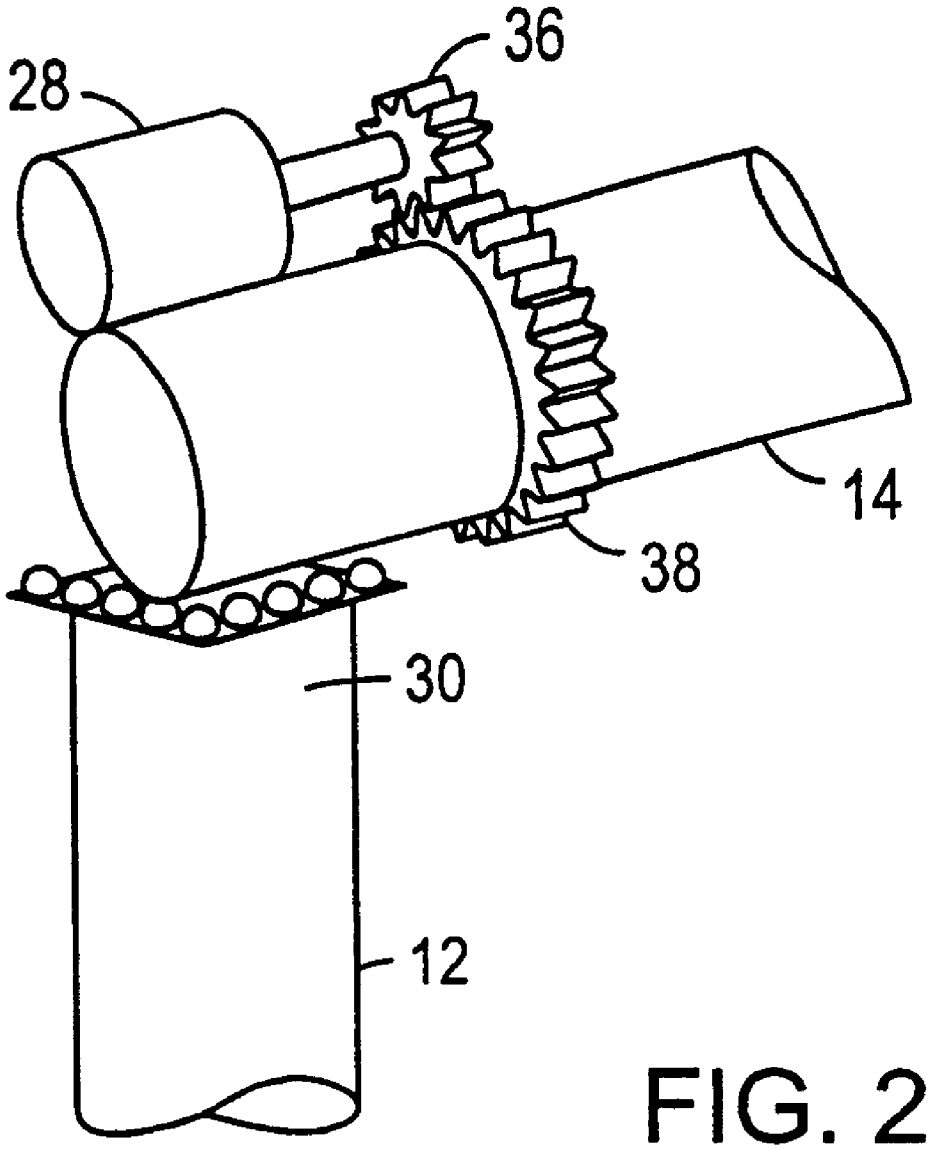
FIG. 2 is a detail view of a portion of the swing ride of FIG. 1, showing an actuator and gear arrangement for rotating the support arm.

Referring to FIG. 2, the actuator 28 is operatively coupled to the support beam 14 to rotate the support arm so that the boom arm 16 and the cam arms 18 pivot between the loading position and the operating position. For example, in a typical commercial embodiment, the actuator 28 is provided by an electric motor such as a 10 HP motor. Alternatively, the actuator can be provided by a hydraulic or pneumatic cylinder, or by another linear or rotary actuator. Such hydraulic or pneumatic actuators can be obtained from the Bearendsen Fluid Power company of Little Rock, Ark. The actuator 28 can be provided with a first gear 36 that engages a second gear 38 coupled to the support beam 14. Alternatively, the ride 10 can be provided with a worm gear, a planetary gear assembly, a reduction gear train, or another gear arrangement for facilitating the raising and lowering of the boom arm 16 and cam arms 18. Also, locking of the boom arm 16 and the cam arms 18 in the operating position can be accomplished by the brake 19 engaging one of the gears 36 or 38, or by deactivating the actuator.

Referring to FIGS. 3A–3D, there is shown the operation of the swing ride 10.

Figure 3A:
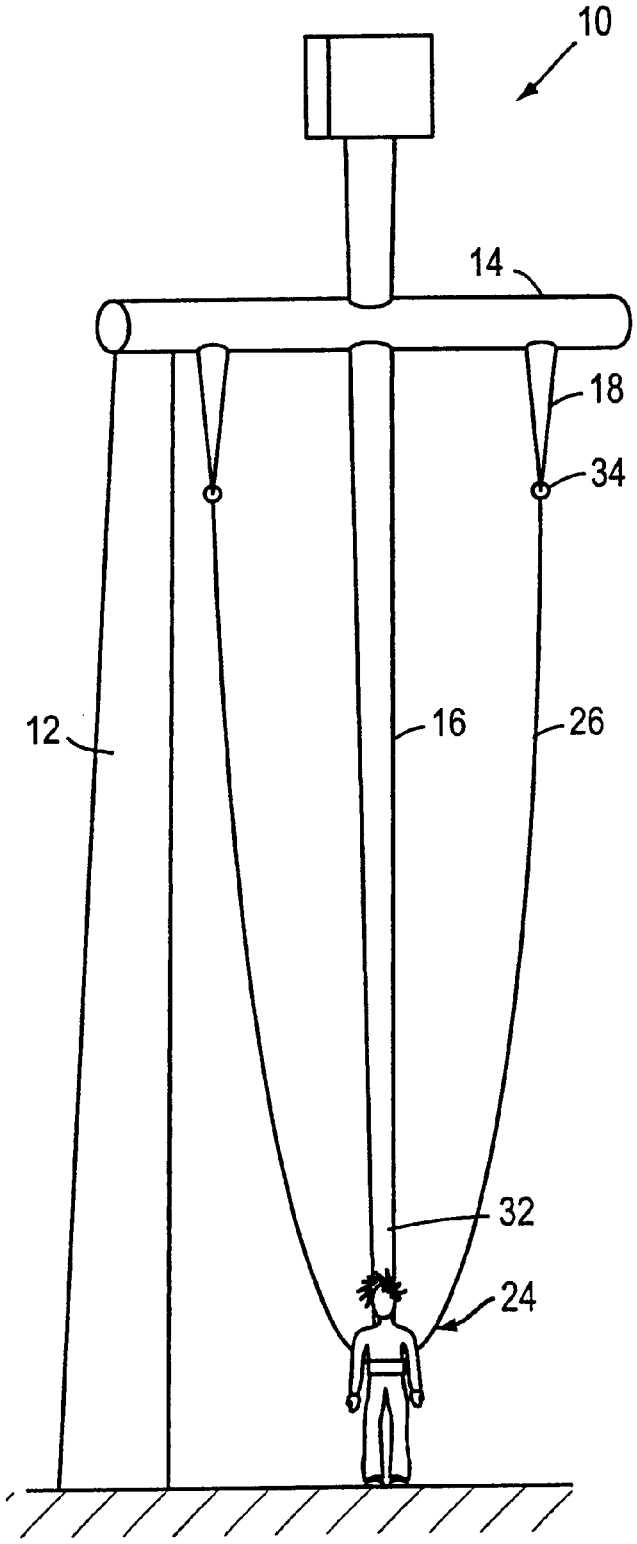
FIG. 3A is a rear perspective view of the swing ride of FIG. 1 in operation, showing the swing ride in the loading position.
Figure 3B:
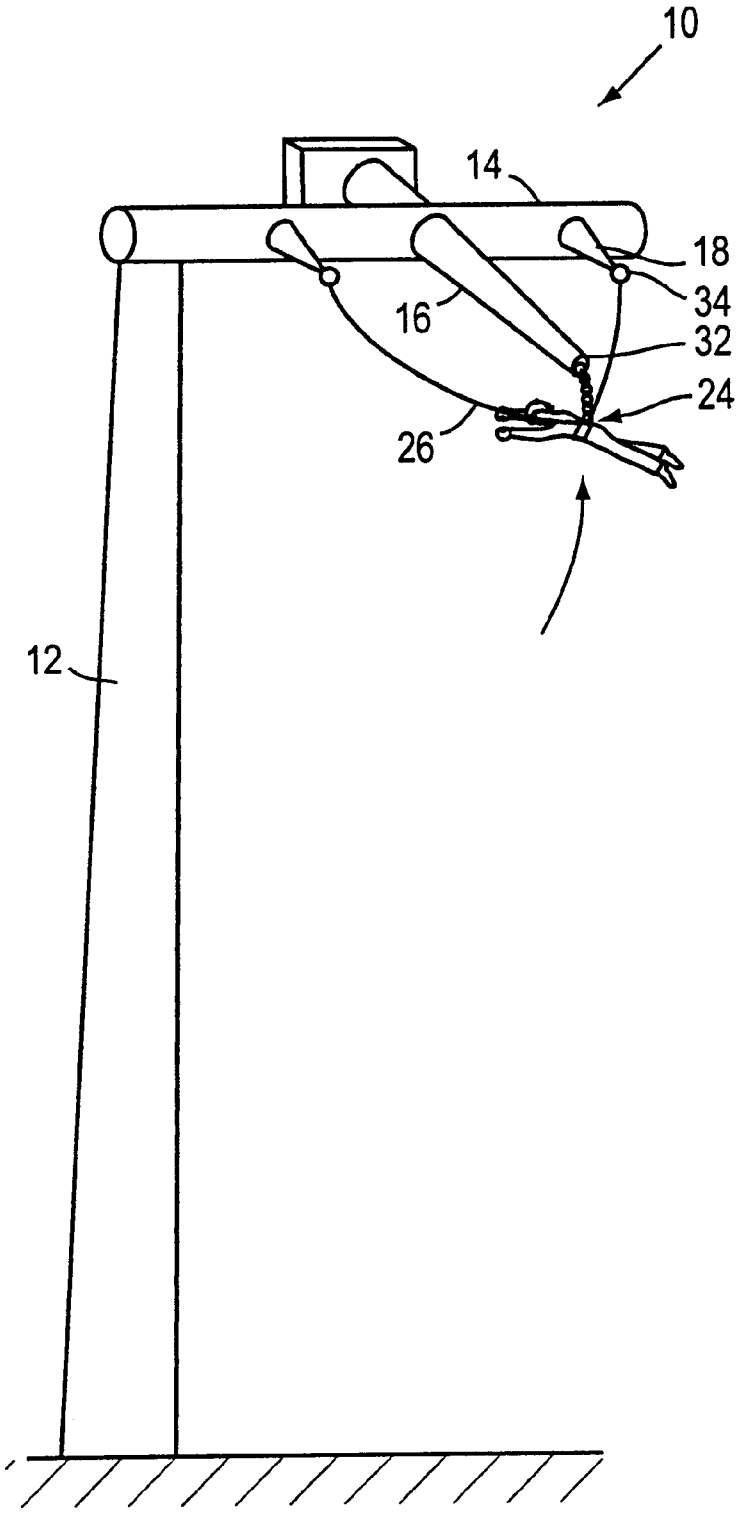
FIG. 3B is a rear perspective view of the swing ride of FIG. 3A in operation, showing the boom arm and the cam arms pivoted to the launch position.

In FIG. 3A, the boom arm 16, the cam arms 18, and the passenger carriage 24 are in the loading position. In this position, the passenger can be loaded into or onto the passenger carriage 24. In FIG. 3B, the support beam 14 is rotated by operation of the actuator to pivot the boom arm 16 and the cam arms 18 upward (as shown by the directional arrow) to the operating position. In this position, the attachment portion 32 of the boom arm 16 is elevated with respect to the attachment portion 32 when in the loading position, and the attachment portions 34 of the cam arms 18 are elevated with respect to the attachment portions 34 when in the loading position. In this way, the passenger carriage 24 is lifted to the launch position by the pivoting boom arm 16, and is now set to be released into the swinging motion. The boom arm 16 and the cam arms 18 are then locked into the operating position by the brake 19.

Figure 3C:
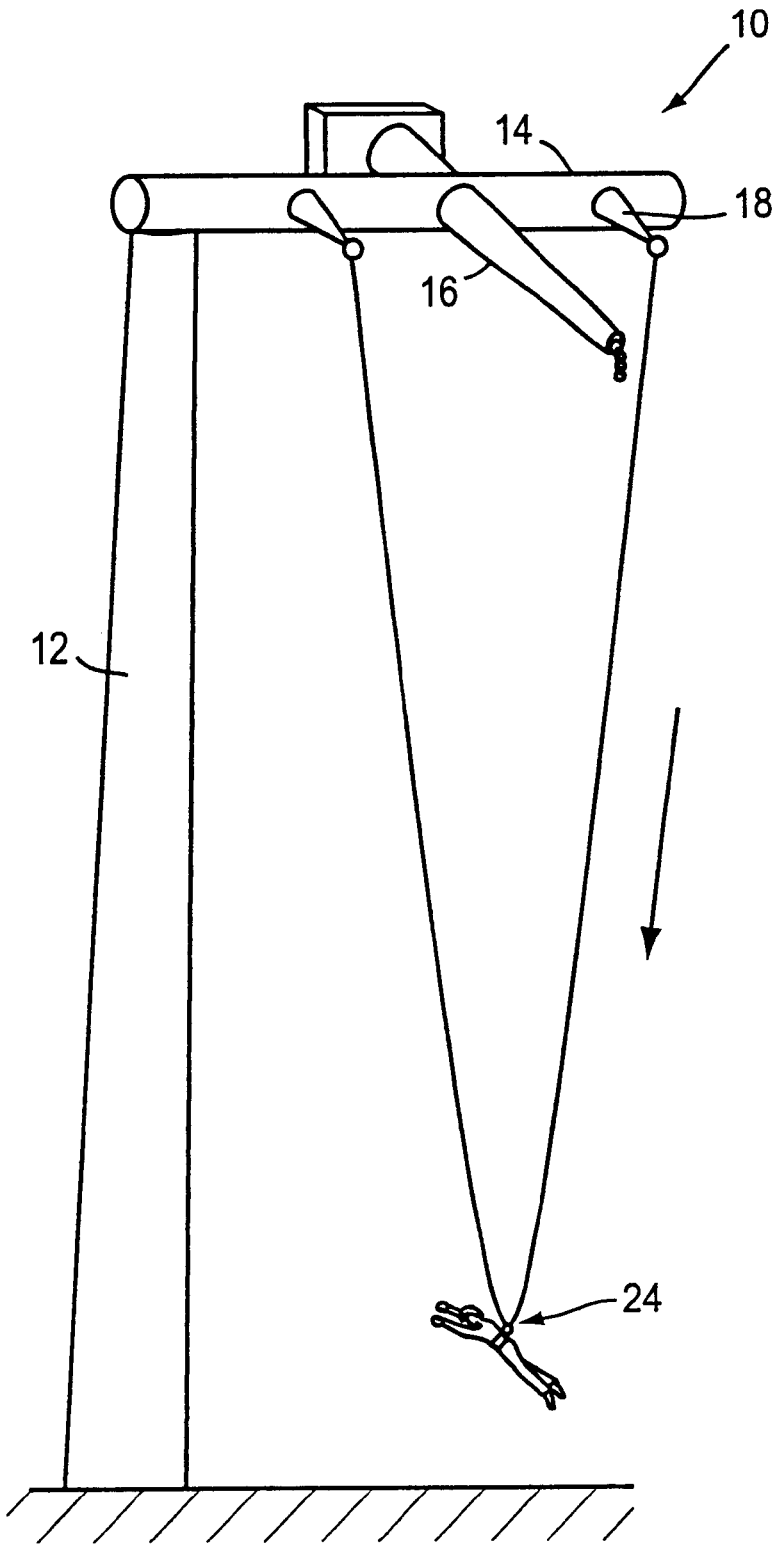
FIG. 3C is a rear perspective view of the swing ride of FIG. 3A in operation, showing the passenger carriage released from the boom arm and swinging back toward the loading position but elevated therefrom.
Figure 3D:
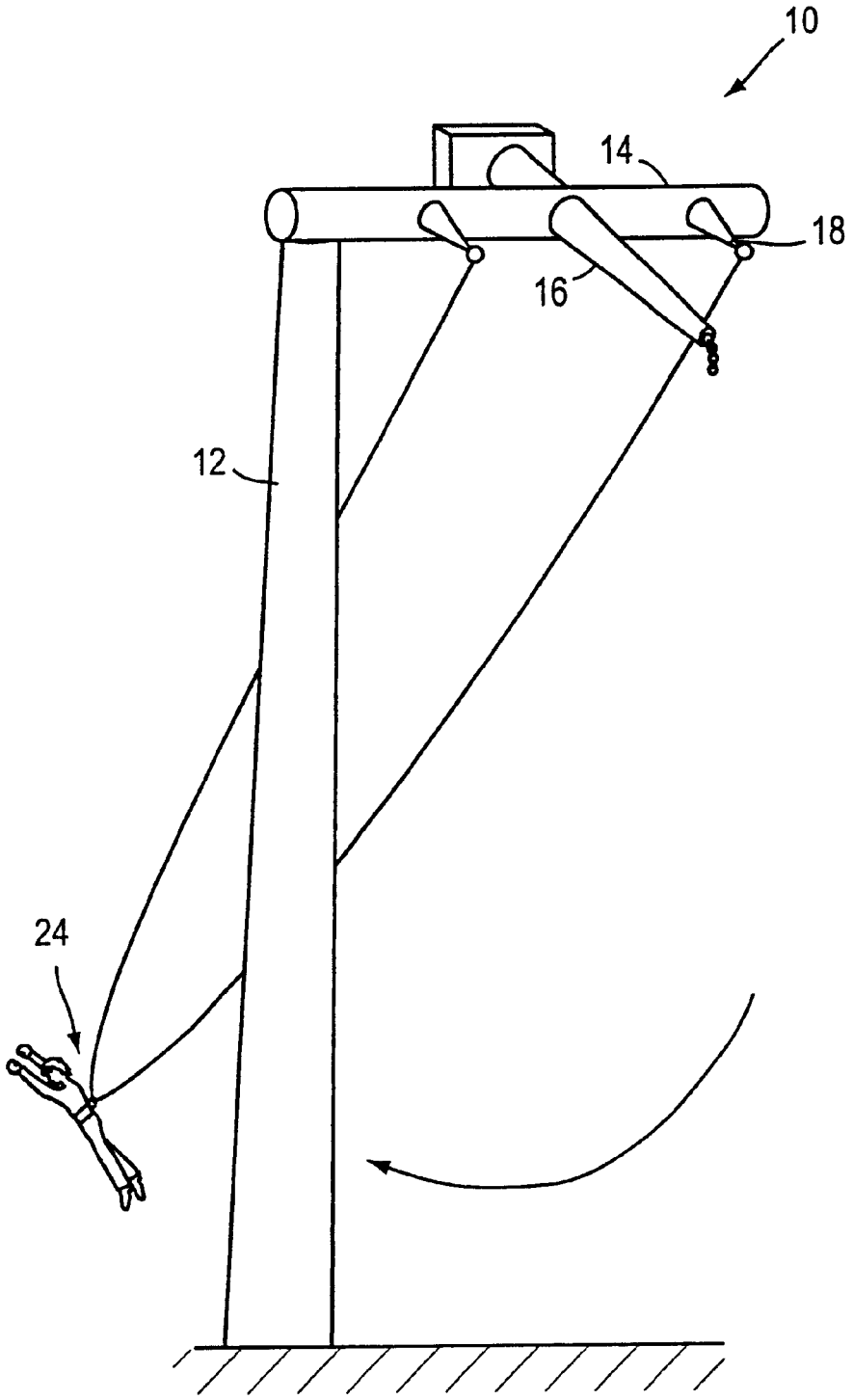
FIG. 3D is a rear perspective view of the swing ride of FIG. 3A, showing the passenger carriage swinging through the air in an arc.

In FIG. 3C, the passenger carriage 24 has been released from the boom arm The carriage 24 then swings downward (as shown by the directional arrow) under the force of gravity. The carriage 24 swings from the cam arms 16 and, at the lowest point of the swinging motion, is elevated from the ground due to the cam arms being in the elevated operating position. In other words, because the cam arms 18 are now pivoted to the elevated operating position, the pivot points (the attachment portions 34) for the swinging motion are correspondingly raised. As shown in FIG. 3D, the momentum of the carriage 24 swings it past the tower 12 (as shown by the directional arrow) and back upward until it stops, then the carriage swings back and forth in a pendulum motion until it comes to a rest. At that point, the boom arm 16 and the cam arms 18 are pivoted downward by operation of the actuator until they return to the loading position. The passenger carriage 24 is thereby lowered to the loading position, and the passenger can be unloaded from the carriage.

Accordingly, the pivoted cam arms 18 provide ground clearance so that the passenger carriage 24 can swing back and forth in the pendulum path elevated safely from the ground, without the need for a winch, lift, movable loading platform, or the like. Also, because the cam arms 18 and the boom arm 16 are mounted on one (or two closely spaced) support tower(s) 12, there is no need for a separate, costly, and land-intensive launch tower. In this way, the swing ride 10 is reliable, safe, and has few moving components so that it is cost-effective to make and use.

Figure 4:
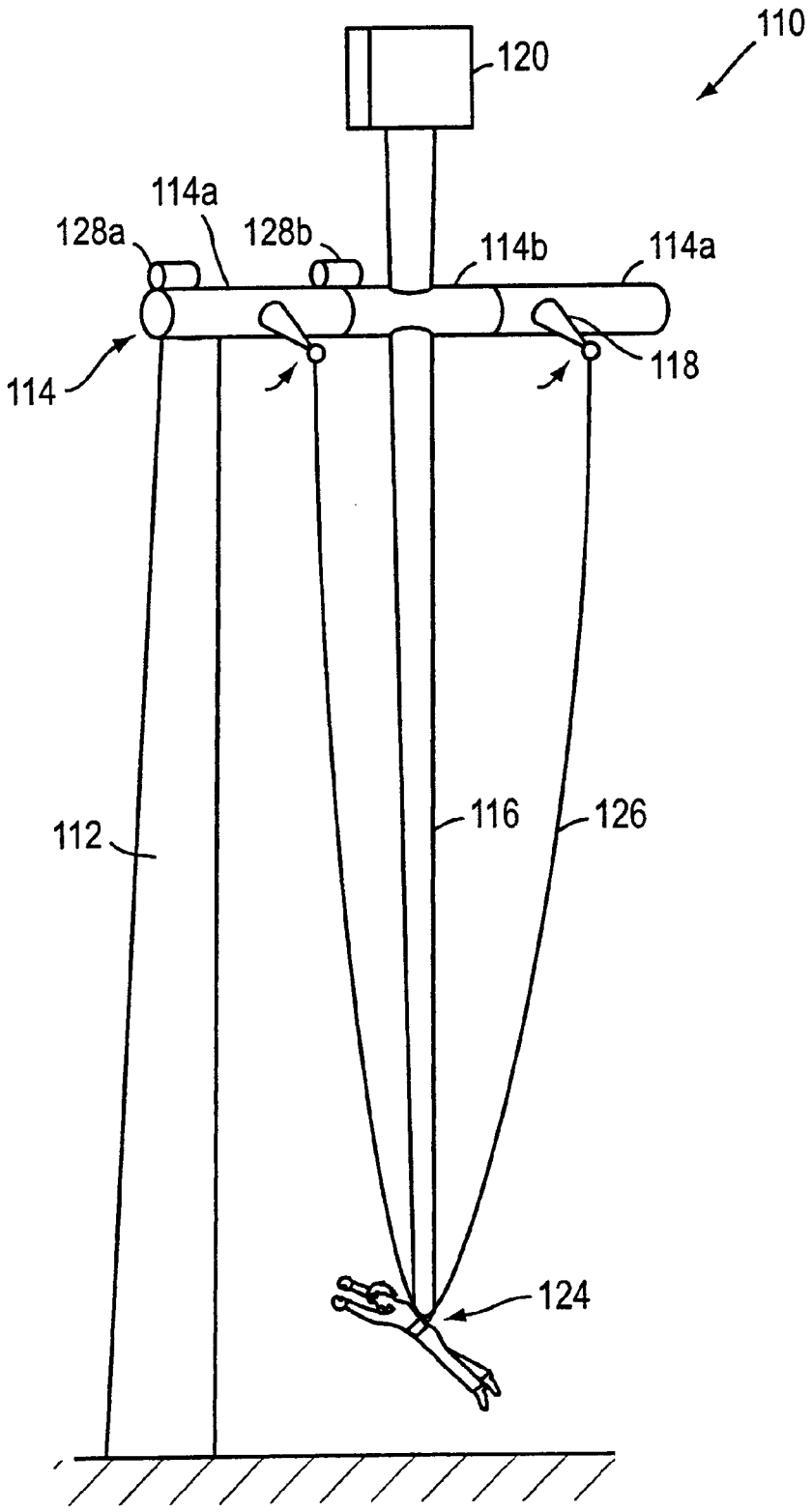
FIG. 4 is a rear perspective view of a second exemplary embodiment of the present invention, showing a swing ride with a support beam having a boom arm and two cam arms that pivot independently from the boom arm.

Referring now to FIG. 4, there is illustrated a second exemplary embodiment of the present invention, referred to generally as the swing ride 110. The swing ride 110 has a tower 112, a boom arm 116, cam arms 118, a counterweight 120, a passenger carriage 124, and cables 126, similar to the first exemplary embodiment. In this embodiment, the swing ride 112 has a support beam 114 with a first portion **114*a* and a second portion 114*b* that rotate independently of each other. The cam arms 118 extend from the first portion 114*a* of the support beam 114 and the boom arm 116 extends from the second portion 114*b*. In this way, the boom arm 118 and the cam arms 116 pivotal independently of each other. A first actuator 128***a* and a second actuator 128*b* are provided that are similar to the actuator of the first embodiment, with the first actuator 128*a* operable to pivot the cam arms 118*a* and the second actuator 128*b* operable to pivot the boom arm 116. In this configuration, the first actuator 128*a* can be operated to pivot the cam arms 118 and lift the passenger carriage 124 off the ground, so that any straps or other passenger securing devices of the carriage can be checked for safety. Then the second actuator 128*b* can be operated to pivot the boom arm 116 to lift the carriage 124 to the launch position for release into the swinging motion.

Figure 5:
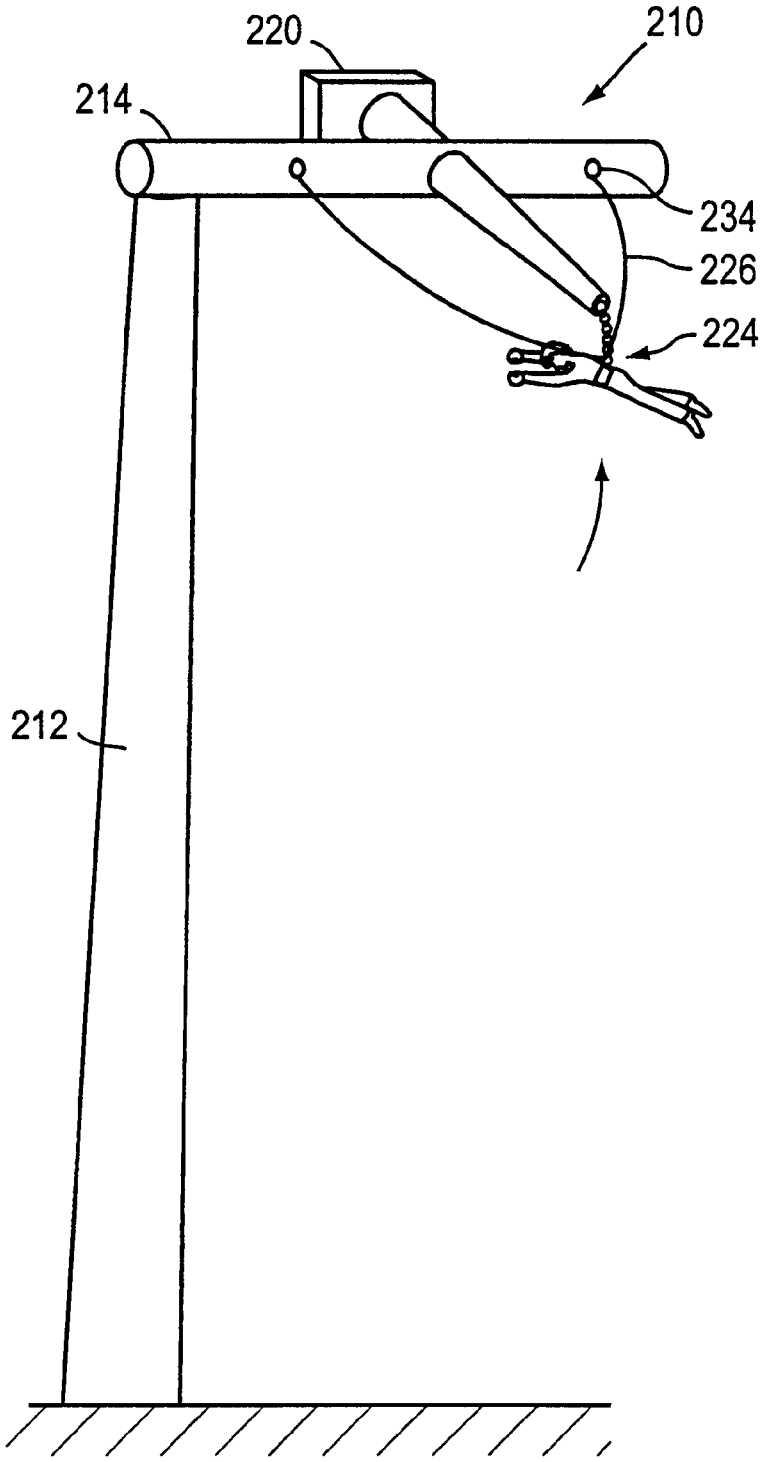
FIG. 5 is a rear perspective view of a third exemplary embodiment of the present invention, showing a swing ride with a support beam having a boom arm that supports the passenger carriage as it swings through the air in an arc.
Figure 6:
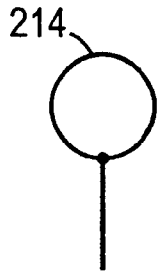
FIG. 6 is a cross section view of the support beam of the swing ride of FIG. 5, showing the support beam in the loading position.
Figure 7:
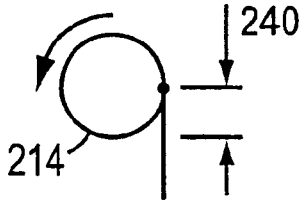
FIG. 7 is a cross section view of the support beam of the swing ride of FIG. 5, showing the support beam in the operating position.

Referring now to FIG. 5, there is illustrated a third exemplary embodiment of the present invention, referred to generally as the swing ride 210. The swing ride 210 has a tower 212, a support beam 214, a boom arm 216, a counterweight 220, a passenger carriage 224, and cables 226, similar to the first exemplary embodiment. In this embodiment, the swing ride 212 has a support beam 214 with attachment portions 234 for the cables 226 formed directly on the support beam 214. As shown in FIGS. 6 and 7, the support beam 214 rotates between a loading position (FIG. 6) and an operating position (FIG. 7) with the attachment portions 234 elevated with respect to the attachment portions 234 in the loading position. Accordingly, when the support beam 214 is rotated to the operating position, the passenger carriage 224 swings back toward the loading position but is elevated with respect to the loading position by the thickness 240 of the support beam. In this fashion, the cam arms of the previously-described embodiments are not needed, but instead the carriage is elevated from the ground by the thickness of the support beam itself, so that the carriage can safely swing back and forth through the air. It will be understood that the support beam 214 can have a uniform thickness or a thickness that varies along the length of the support beam.

Figure 8:
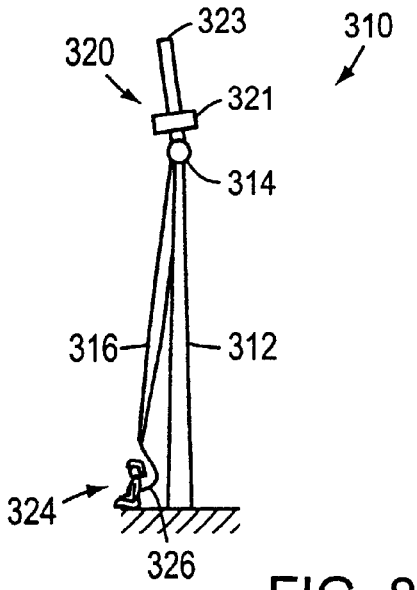
FIG. 8 is a side elevation view of a fourth exemplary embodiment of the present invention, showing a swing ride with a movable counterweight body positioned closer to the support beam and the boom arm in the loading position.
Figure 9:
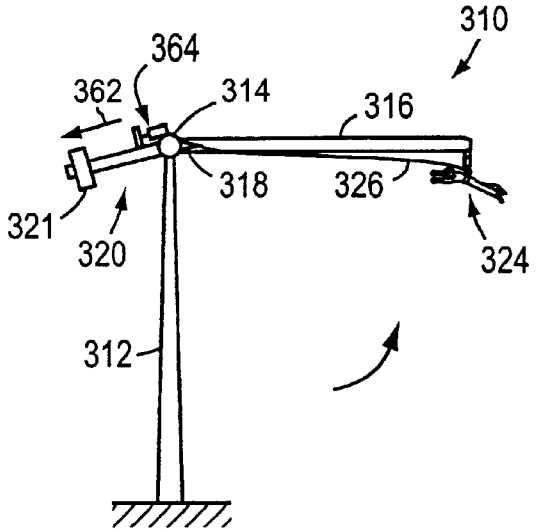
FIG. 9 is a side elevation view of the swing ride of FIG. 8, showing the movable counterweight positioned farther away from the support beam and the boom arm in the operating position.

Referring now to FIGS. 8 and 9, there is illustrated a fourth exemplary embodiment of the present invention, referred to generally as the swing ride 310. The swing ride 310 has a tower 312, a support beam 314, a boom arm 316, cam arms 318, a passenger carriage 324, and cables 326, similar to the first exemplary embodiment. In this embodiment, the swing ride 310 has a counterweight 320 that includes a body 321 movably mounted to an elongate arm 323 so that the body can be moved along the length of the arm to a position closer to or farther from the support beam 314. By moving the counterweight body 321 along the counterweight arm 323, the downward counterbalancing force produced by the counterweight 320 is decreased or increased. In this way, the counterweight 320 is able to better assist in raising and lowering the boom arm 316, or to by itself raise and lower the boom arm without the need for the actuator to rotate the support beam 314. In order to raise and lower the boom arm 316 without the actuator for the support beam 314, the counterweight arm 323 can be positioned at an angle of less than about 180 degrees but more than about 90 degrees from the boom arm 316 (which position is included in the meaning of "generally opposite" as used herein to describe the position of the counterweight).

As shown in FIG. 8, when the boom arm 316 is in the lowered loading position, the movable counterweight body 321 is positioned relatively closer to the support beam 314. In this position, the counterweight body 321 exerts a downward force with a shorter moment arm (the portion of the elongate arm 323 between the support beam and the body), thereby producing a relatively small downward force. The relatively larger downward force of the boom arm 316 and its passenger load will therefore tend to urge the boom arm to stay in the lower loading position.

As shown in FIG. 9, in order to raise the boom arm 316 to the operating position, the movable counterweight body 321 is moved to a position relatively farther from the support beam 314. As the counterweight body 321 moves toward this position, the counterweight body 321 exerts a downward force with an increasingly longer moment arm resulting in increasingly larger downward forces. At some point, this will cause the support beam 314 to start rotating to pivot the boom arm 316. The counterweight body 321 is moved away from the support beam 314 until the boom arm 316 is pivoted upward to the operating position. The body 321 then is kept in this position while the passenger carriage 326 swings through the air, then after the completion of the ride, the body is moved back to the position closer to the support beam 314, thereby causing the boom arm to pivot back to the loading position. Of course, the body 321 can be moved to intermediate positions to provide other counterbalancing effects, for loading passengers or releasing the carriage 326 at various other positions, as may be desired.

Figure 10:
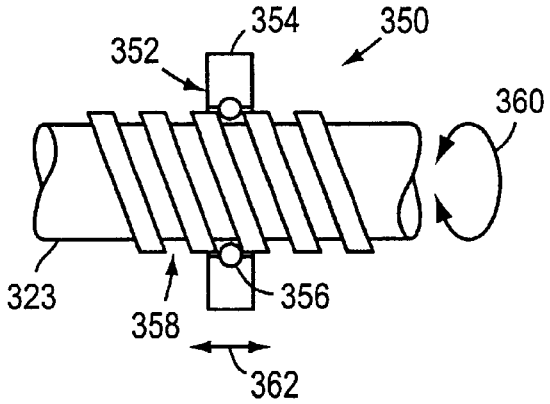
FIG. 10 is a side detail view of the movable coupling that supports the counterweight body on the counterweight arm of FIG. 8.
Figure 11:
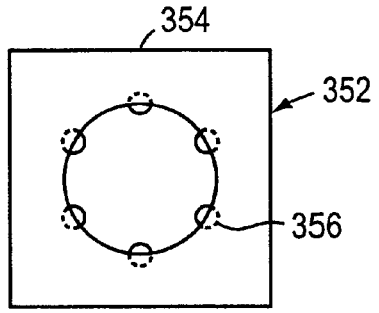
FIG. 11 is a front detail view of the movable coupling of FIG. 10.

Referring now to FIGS. 10 and 11, the counterweight body 321 is movably mounted to the counterweight arm 323 by a movable coupling 350 that is attached to the body and that is at least partially supported by the arm so that the body can move back and forth along the arm. For example, the movable coupling 350 can be provided by a ball screw 352 having a ball nut 354 with a plurality of bearings 356 (such as ball, roller, or other bearings) that ride in helical grooves 358 formed in the counterweight arm 323. When the arm 323 is rotated as shown by directional arrow 360, the bearings 356 roll in the grooves 358, causing the ball nut 354 to move axially along the arm 323 as shown by directional arrow 362. The arm 323 is rotated by operation of an actuator 364 (see FIG. 9) such as a rotary or linear electric motor, hydraulic or pneumatic cylinder, or the like, connected directly to the arm or operatively connected to the arm by one or more gears, couplings, joints, pulleys, or the like. Also, in order to prevent or minimize rotation of the body 321 when the arm 321 is rotated, the movable coupling 350 can be eccentrically positioned or the body can be irregularly shaped so that more of the weight of the body is below the arm 321 than above. Alternatively, the body 321 can be rotated (for example, by a gear on the body and a cooperating spur gear connected to an actuator) to cause the body to move axially along the arm 323. In other alternative embodiments, the movable coupling 350 can be provided by a single bearing that rolls in a single longitudinal groove in the top of the counterweight arm 323, by one or more movable bearings on top of the arm that support the counterweight body 321 (or a portion thereof) above the arm, by one or more movable bearings on bottom of the arm with the counterweight body 321 suspended below the arm, by a plurality of movable couplings that movably support a plurality of counterweight bodies, by a conveyor belt mechanism mounted to the arm, or by other movable couplings that are known in the art.

Figure 12:
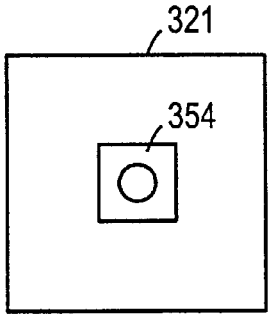
FIG. 12 is a front view of the counterweight body of FIG. 8, showing the movable coupling mounted thereto.
Figure 13:
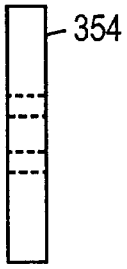
FIG. 13 is a side view of the counterweight body of FIG. 12.
Figure 14:
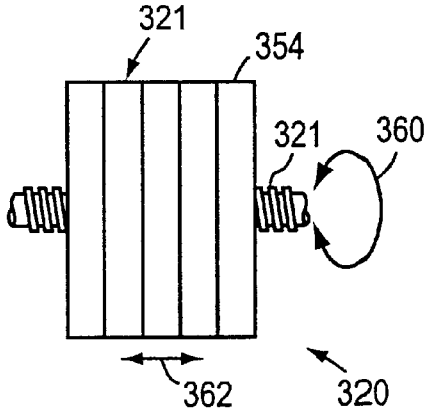
FIG. 14 is a side detail view of a plurality of the counterweight bodies of FIG. 8 movably mounted onto the counterweight arm.

Referring to FIGS. 12 and 13, the counterweight body 321 can be provided by a plate with the ball nut 354 captured therein so that the body does not rotate when the arm 323 does. Alternatively, the body 321 can be provided by a block, disc, or other regular or irregularly shaped body. Also, as shown in FIG. 14, the counterweight 320 can include a number of the counterweight bodies 321 stacked closely together or spaced apart, as may be desired for a particular ride.

Figure 15:
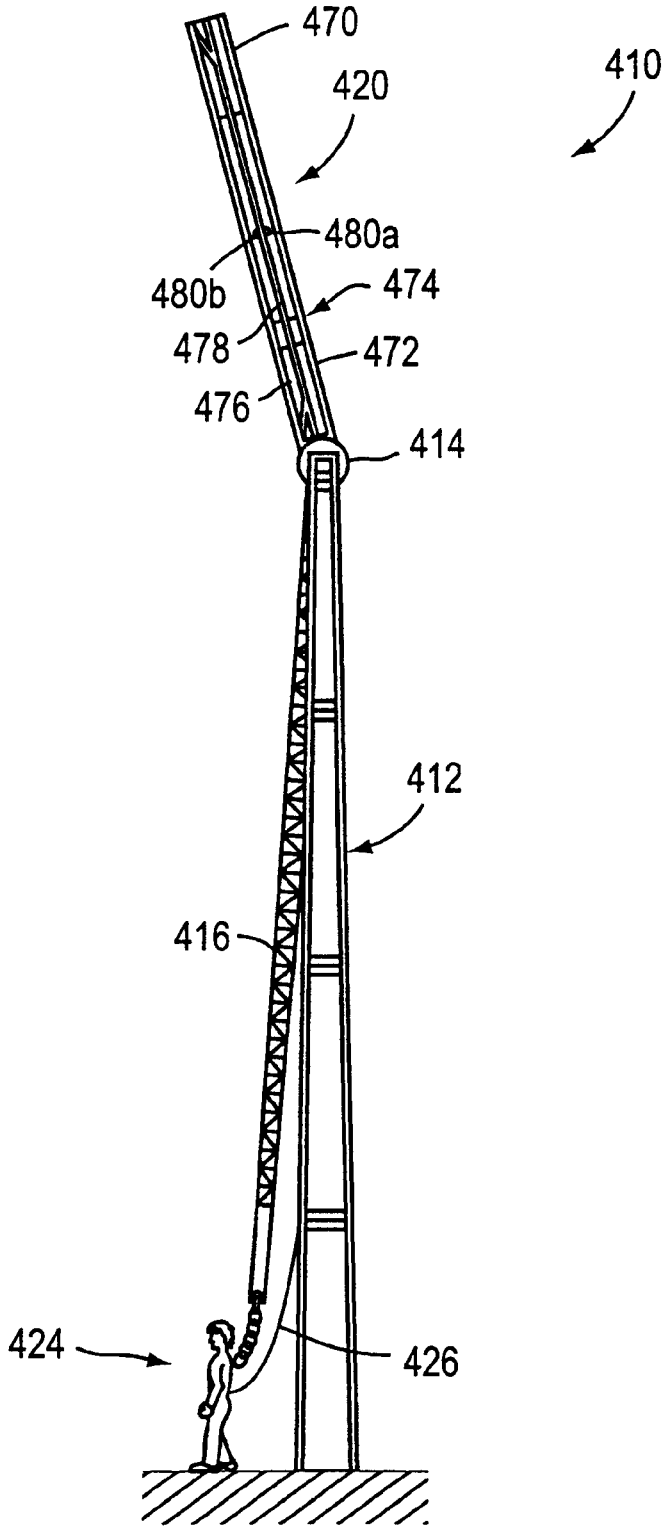
FIG. 15 is a side elevation view of a fifth exemplary embodiment of the present invention, showing a swing ride with a counterweight fluid moved to a first storage tank and the boom arm in the loading position.
Figure 16:
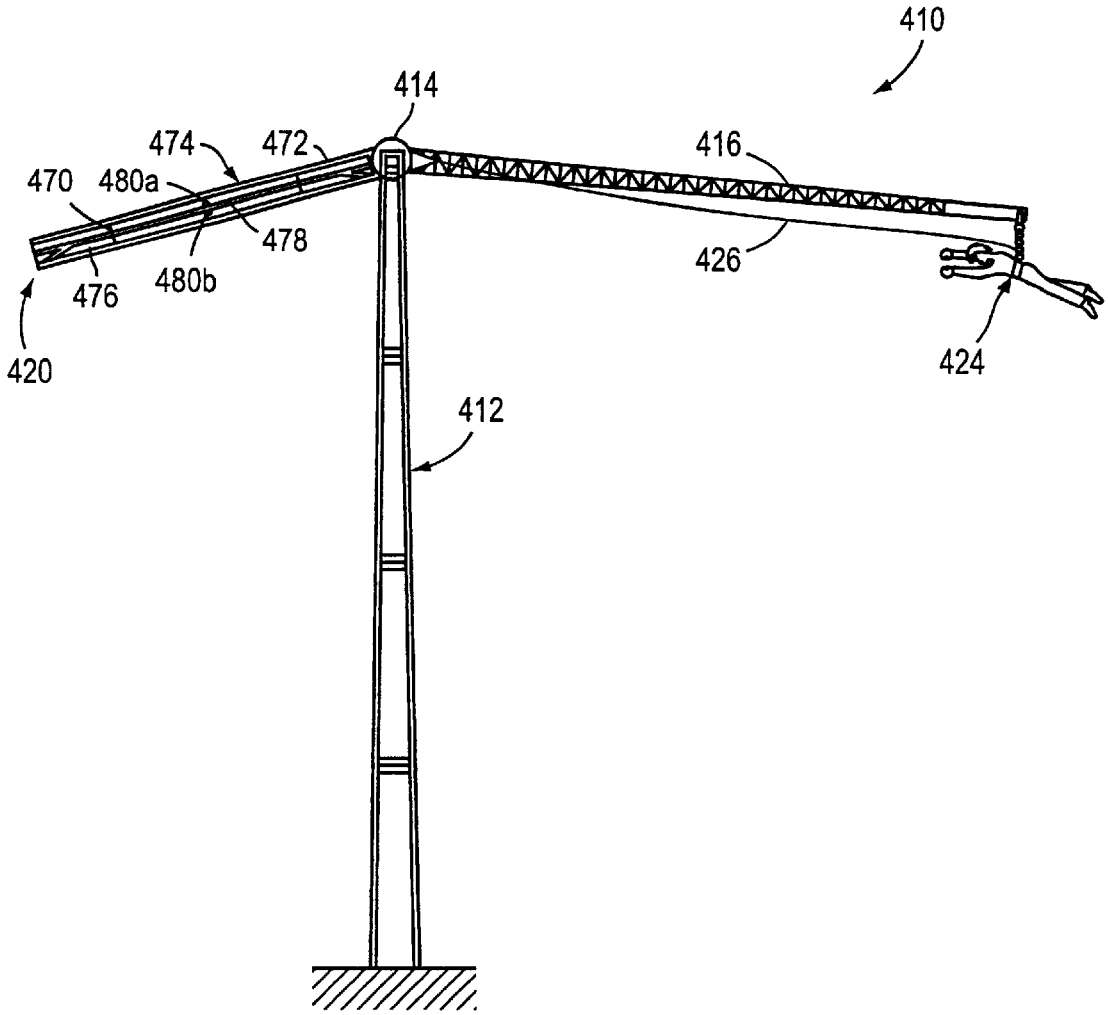
FIG. 16 is a side elevation view of the swing ride of FIG. 15, showing the counterweight fluid moved to a second storage tank, and the boom arm in the operating position.

Referring now to FIGS. 15 and 16, there is illustrated a fifth exemplary embodiment of the present invention, referred to generally as the swing ride 410. The swing ride 410 has a tower 412, a support beam 414, a boom arm 416, cam arms 418, a passenger carriage 424, and cables 426, similar to the first exemplary embodiment. In this embodiment, a movable counterweight 420 is provided that operates to accomplish the same function of assisting in the raising and lowering the boom arm as the swing ride 310 of the fourth embodiment. However, in this embodiment, the movable counterweight 420 includes first and second storage tanks 470 and 472 and a counterweight fluid 476 such as water or another fluid. The first and second storage tanks 470 and 472 are formed in or mounted to a counterweight arm 474 and are spaced apart from each other with the first tank 472 being farther from the support beam 414 than the second tank 474. A conduit 478 connects the tanks 460 and 472, and one or more actuators such as pumps 480*a* and 480*b* are operative to transport the counterweight fluid 476 through the conduit and between the tanks. The pumps 480*a* and 480*b* can be mounted to or within the counterweight arm 474, or can be located remotely therefrom and connected to the conduit 478 by feed lines. Of course, another number or storage tanks, conduits, and/or pumps can be provided to accomplish the transfer of weight, as may be desired in a particular application.

As shown in FIG. 15, when the counterweight fluid 476 is in the second tank 472, the boom arm 416 is urged downward to the lowered loading position. To pivot the boom arm 416 to the operating position shown in FIG. 16, the pumps 480*a* and 480*b* are operated to transport the counterweight fluid 476 through the conduit from the second tank 472 to the first tank 470. The structure and operation, and alternative embodiments thereof, of a similar counterweight are described in greater detail in U.S. Pat. No. 5,658,201.

In another aspect of the present invention, there is provided a method for swinging at least one passenger, which is best shown with reference to FIGS. 3A–3D). The method preferably comprises providing a support tower, a support beam rotationally coupled to the support tower and having a boom arm and two cam arms extending therefrom so that the boom arm and the cam arms are pivotal between a loading position and a operating position elevated with respect to the loading position, a passenger carriage releasably coupled to the boom arm and movable between a loading position and a launch position elevated with respect to the loading position, and two cables attached between the cam arms and the passenger carriage.

The method includes positioning the passenger carriage in the loading position, loading the passenger into or onto the passenger carriage, and pivotally lifting the boom arm and the cam arms to the operating position so that the passenger carriage is lifted to the launch position. For example, an actuator can be operatively coupled to the support beam, and the boom arm and the cam arms can be pivotally lifted to the operating position by operating the actuator to rotate the support arm. The method further comprises locking the cam arms from pivoting from the operating position to the loading position during operation of the ride, releasing the passenger carriage from the boom arm, and permitting the passenger carriage to swing under the force of gravity and independently of the boom arm, so that the passenger carriage swings back toward the loading position but is elevated with respect to the loading position by the elevated cam arms in the operating position.

Additionally, the method comprises permitting the passenger carriage to swing back and forth from the cam arms, with the carriage swinging safely above the ground due to the arms being pivotally elevated from the ground and locked in the operating position. The carriage swings back and forth until it stops or is stopped, thereby providing a thrill to the passenger. Furthermore, at the conclusion of the ride, the method includes pivoting the cam arms back to the loading position thereby lowering the carriage to the loading position, and unloading the passenger from the passenger carriage. The method further comprises lowering the boom arm to the loading position for reattaching the carriage for the next ride.

In alternative methods, the cam arms are pivoted to the operating position before the boom arm is likewise pivoted, the passenger carriage swings from a support beam with a thickness sufficiently large that carriage wings safely above the ground (without the cam arms), and/or the boom arm is pivoted to the operating position by operation of a counterweight actuator that moves a counterweight body or fluid closer to or farther from the support beam. Of course, the present method of swinging a passenger can be accomplished by other methods using similar or different amusement rides.

In view of the foregoing, it will be appreciated that present invention provides a giant swing amusement ride that safely swings a rider back and forth through the air. Because the support tower both elevates and swings the passenger carriage, there is no need for duplicative, costly, and land-intensive support and launch towers, so that the swing ride has a small footprint and requires less ground space than known swing rides. Additionally, because of the unique pivotal cam arm arrangement (or attachment portion of the support beam), the swing ride swings the passenger carriage with plenty of clearance from the ground without the need for a winch, lift, platform, or other the like. Furthermore, because of the movable counterweight, the boom arm can be easily raised and lowered without a boom arm actuator or with a relatively low powered actuator.

It will be understood that, in the embodiments described above and the following claims, the words "a," "an," and "one" are not intended to mean "only one" but can also mean "any number greater than one," unless specified otherwise herein. Also, terms used in the plural form are not intended to mean "only more than one," but can also mean "only one," unless specified otherwise herein. Additionally, the methods described herein are not intended to be limited to the sequence of steps set forth, unless specified otherwise. It should be understood that the foregoing description relates only to the exemplary embodiments of the present invention, and that numerous changes may be made therein without departing from the spirit and scope of the invention as defined by the following claims

The invention claimed is:

1. An amusement ride, comprising:

a) a support tower;

b) a support beam extending from the support tower and having one or more cam arms extending therefrom, the cam arms each having an attachment portion, wherein the cam arms are movable between a loading position and an operating position with the attachment portions elevated with respect to the attachment portions in the loading position;

c) a passenger carriage; and d) one or more cables attached to the attachment portions of the cam arms and to the passenger carriage, wherein the passenger carriage swings safely above the ground from the attachment portions of the cam arms in the elevated operating position.

2. The amusement ride of claim 1, wherein the cam arms are selectively locked in the operating position during operation of the amusement ride.

3. The amusement ride of claim 1, wherein the passenger carriage is movable between a loading position and a launch position elevated with respect to the loading position, and, when the passenger carriage is released from the launch position, the passenger carriage swings back toward the loading position but is elevated with respect to the loading position by the elevated cam arms in the operating position.

4. The amusement ride of claim 1, further comprising an actuator that operates to move the cam arms between the loading position and the operating position.

5. The amusement ride of claim 4, wherein the support beam is rotationally coupled to the support tower, and the actuator operates to rotate the support arm causing the cam arms to pivot between the loading position and the operating position.

6. The amusement ride of claim 1, further comprising a boom arm extending from the support beam, the boom arm having an attachment portion with the passenger carriage releasably coupled thereto, wherein the boom arm is movable between a loading position and an operating position with the attachment portion elevated with respect to the attachment portion in the loading position.

7. The amusement ride of claim 6, wherein the boom arm and the cam arms are generally vertically disposed when in the loading position and are angled therefrom when in the operating position.

8. The amusement ride of claim 6, further comprising a fixed or movable counterweight extending from the support beam and disposed generally opposite from the boom arm.

9. An amusement ride, comprising:

a) a support tower;

b) a support beam extending from the support tower and having a boom arm extending therefrom that is pivotal between a loading position and an operating position elevated with respect to the loading position;

c) a passenger carriage releasably coupled to the boom arm and movable between a loading position and a launch position elevated with respect to the loading position; and d) one or more cables attached to the support beam and to the passenger carriage, wherein the passenger carriage is raised from the loading position to the launch position when the boom arm is pivoted from the loading position to the operating position, and the passenger carriage swings from the support beam when the passenger carriage is released from the boom arm.

10. The amusement ride of claim 9, further comprising an actuator that operates to move the boom arm between the loading position and the operating position.

11. The amusement ride of claim 10, wherein the support beam is rotationally coupled to the support tower, and the actuator operates to rotate the support arm causing the boom arm to pivot between the loading position and the operating position.

12. The amusement ride of claim 9, wherein the support beam has one or more attachment portions that rotate between a loading position and a operating position with the attachment portions elevated with respect to the attachment portions in the loading position, and wherein the cables are attached to the attachment portions.

13. The amusement ride of claim 12, wherein the support beam has a thickness such that, when the boom arm is pivoted to the operating position and the passenger carriage is released therefrom, the passenger carriage swings back toward the loading position but is elevated with respect to the loading position by the thickness of the support beam.

14. The amusement ride of claim 12, wherein the support beam has one or more cam arms extending therefrom, and the support beam attachment portions are disposed on the cam arms.

15. The amusement ride of claim 9, wherein the support beam extends generally horizontally from the support tower, and the boom arm extends generally perpendicularly from the support beam and is generally vertically disposed when in the loading position and generally horizontally disposed when in the operating position.

16. The amusement ride of claim 9, wherein only one support tower is provided, and both the boom arm that lifts the passenger carriage from the loading position to the launch position and the support beam that supports the passenger carriage during swinging are supported by the one support tower.

17. The amusement ride of claim 9, further comprising a fixed or movable counterweight extending from the support beam and disposed generally opposite from the boom arm.

18. An amusement ride, comprising:

a) a support tower;

b) a support beam rotationally coupled to the support tower and having a boom arm and one or more cam arms extending therefrom, the boom arm and cam arms each having an attachment portion, wherein the boom arm and the cam arms are pivotal between a loading position and an operating position with the attachment portions elevated with respect to the attachment portions in the loading position, and the cam arms are selectively locked in the operating position during operation of the ride;

c) a passenger carriage releasably coupled to the attachment portion of the boom arm;

d) one or more cables attached to the attachment portions of the cam arms and to the passenger carriage; and e) a first actuator operatively coupled to the support beam, wherein the actuator operates to rotate the support beam to pivot the boom arm and the cam arms between the loading position and the operating position, wherein when the passenger carriage is released from the boom arm in the operating position, the passenger carriage swings safely above the ground from the attachment portions of the cam arms in the elevated operating position.

19. The amusement ride of claim 18, wherein the passenger carriage is movable between a loading position and a launch position elevated with respect to the loading position, and, when the passenger carriage is released from the boom arm in the operating position, the passenger carriage swings back toward the loading position but is elevated with respect to the loading position by the elevated cam arms in the operating position.

20. The amusement ride of claim 18, wherein the cam arms each have a length that is shorter than a length of the boom arm and that is sufficiently long so that the passenger carriage swings above and does not contact the ground.

21. The amusement ride of claim 18, wherein the support beam is generally horizontally disposed and the boom arm and the cam arms extend generally perpendicularly from the support beam.

22. The amusement ride of claim 18, wherein the passenger carriage is releasably attached to the boom arm by a tether that is attached to the boom arm and releasably coupled to the passenger carriage.

23. The amusement ride of claim 18, further comprising a fixed or movable counterweight extending from the support beam and disposed generally opposite of the boom arm.

24. The amusement ride of claim 23, wherein the counterweight comprises an elongate counterweight arm attached to the support beam and a counterweight body movably attached to the counterweight arm by a movable coupling.

25. The amusement ride of claim 24, wherein the movable coupling comprises a ball screw.

26. The amusement ride of claim 23, wherein the counterweight comprises an elongate counterweight arm with at least two fluid storage tanks formed therein or thereon, and a counterweight fluid transportable between the storage tanks.

27. The amusement ride of claim 18, wherein the boom arm and the cam arms are pivotally coupled to the support beam so that the boom arm and the cam arms pivot independently of each other.

28. The amusement ride of claim 27 further comprising a second actuator operatively coupled to the boom arm, wherein the first actuator operates to pivot the cam arms and the second actuator operates to pivot the boom arm.

29. An amusement ride, comprising:

a) a support tower with a portion elevated from the ground;

b) a support beam extending generally horizontally from and rotationally coupled to the elevated portion of the support tower, the support beam having a boom arm and two cam arms extending generally perpendicularly therefrom and a counterweight extending therefrom generally opposite from the boom arm, the boom arm and cam arms each having an attachment portion, wherein the boom arm and the cam arms are pivotal between a generally vertical loading position and a generally horizontal operating position with the attachment portions elevated with respect to the attachment portions in the loading position, the cam arms each have a length that is shorter than a length of the boom arm and that is sufficiently long so that the passenger carriage swings above and does not contact the ground when the cam arms are in the operating position, and the cam arms are selectively locked in the operating position during operation of the ride;

c) a tether attached to the attachment portion of the boom arm;

d) a passenger carriage releasably coupled to the tether;

e) two cables each one attached to one of the attachment portions of one of the cam arms and to the passenger carriage; and f) a first actuator operatively coupled to the support beam, wherein the actuator operates to rotate the support arm so that the boom arm and the cam arm pivot between the loading position and the operating position, wherein when the passenger carriage is released from the boom arm in the operating position, the passenger carriage swings safely above the ground from the attachment portions of the cam arms in the elevated operating position.

30. The amusement ride of claim 29, wherein the boom arm and the cam arms are pivotally coupled to the support beam so that the boom arm and the cam arms pivot independently of each other.

31. The amusement ride of claim 30, further comprising a second actuator operatively coupled to the boom arm, wherein the first actuator operates to pivot the cam arms and the second actuator operates to pivot the boom arm.

32. The amusement ride of claim 29, wherein the tower is angled from vertical.

33. The amusement ride of claim 29, wherein the boom arm is interposed between the cam arms.

34. The amusement ride of claim 29, further comprising a first gear coupled to the first actuator and a second gear coupled to the support beam and engaging the first gear, wherein the support beam is rotated upon operation of the first actuator.

35. The amusement ride of claim 34, further comprising a brake operatively coupled to the support beam, wherein the cam arms and the boom arm are selectively locked in the operating position by the operation of the brake.

36. The amusement ride of claim 29, wherein the counterweight comprises a counterweight body movably mounted on or to a counterweight arm by a movable coupling that is mounted to the support beam.

37. The amusement ride of claim 29, wherein the counterweight comprises at least two storage tanks and a counterweight fluid transportable between the tanks.

38. A method for swinging at least one passenger, comprising:

a) providing an amusement ride comprising support tower, a support beam rotationally coupled to the support tower and having a boom arm extending therefrom and one or more attachment portions formed thereon so that the boom arm and the attachment portions are pivotal between a loading position and a operating position elevated with respect to the loading position, a passenger carriage releasably coupled to the boom arm and movable between a loading position and a launch position elevated with respect to the loading position, and two cables attached between attachment portions and the passenger carriage;

b) positioning the passenger carriage in the loading position;

c) loading the passenger into or onto the passenger carriage;

d) pivotally lifting the boom arm and attachment portions of the support beam to the operating position, wherein the passenger carriage is lifted to the launch position;

e) releasing the passenger carriage from the boom arm; and f) permitting the passenger carriage to swing under the force of gravity and independently of the boom arm, wherein the passenger carriage swings back toward the loading position but is elevated with respect to the loading position by the elevated attachment portions in the operating position.

39. The method of claim 38, wherein the attachment portions are formed on one or more cam arms extending from the support beam.

40. The method of claim 38, further comprising locking the boom arm and the attachment portions in the operating position during operation of the ride.

41. The method of claim 38, further comprising providing an actuator operatively coupled to the support beam, wherein the step of pivotally lifting the boom arm and the attachment portions to the operating position is accomplished by operating the actuator to rotate the support arm.

42. The method of claim 38, further comprising permitting the passenger carriage to swing back and forth, permitting the carriage to swing until it stops or is stopped, pivoting the attachment portions to the loading position thereby lowering the carriage to the loading position, and unloading the passenger from the passenger carriage.

43. The method of claim 38, wherein the step of lifting the boom arm comprises pivoting the attachment portions to the operating position before pivoting the boom arm to the operating position.

44. The method of claim 38, further comprising providing a counterweight with a counterweight body movably coupled to a counterweight arm that is mounted to the support beam, the step of pivotally lifting the boom arm to the operating position further comprising moving the counterweight body away from the support beam.

45. The method of claim 38, further comprising providing a counterweight with two or more storage tanks and a counterweight fluid, the step of pivotally lifting the boom arm to the operating position further comprising transporting the counterweight fluid from one of the tanks to another of the tanks.

* * * * *